US005117859A

United States Patent [19]

Carlson

[11] Patent Number: 5,117,859

[45] Date of Patent: Jun. 2, 1992

[54] FLEXIBLE HOSE RETRACTOR

[75] Inventor: James B. Carlson, 17208 N. 7th St., Phoenix, Ariz. 85022

[73] Assignees: Elden Barbieri; James Carlson, both of Phoenix, Ariz. ; a part interest

[21] Appl. No.: 615,296

[22] Filed: Nov. 19, 1990

[51] Int. Cl.[5] ..... A62C 35/00

[52] U.S. Cl. ..... 137/355.25; 137/377; 242/47.5

[58] Field of Search ..... 242/47.5; 137/355.23, 137/355.25, 377

[56] References Cited

U.S. PATENT DOCUMENTS

| | | | |
|---|---|---|---|
| 1,468,620 | 9/1923 | Addy | 137/355.23 |
| 1,518,881 | 12/1924 | Walker et al. | 137/355.25 |
| 1,928,178 | 9/1933 | Holmgreen | 137/355.25 |
| 2,002,777 | 5/1935 | Johnson | 137/355.23 |
| 2,026,327 | 4/1935 | Sparling | 137/355.25 |
| 2,157,887 | 5/1939 | Davis | 137/355.25 |
| 2,168,951 | 8/1939 | Caldwell | 137/355.25 |
| 2,225,859 | 12/1940 | Cox | 137/355.25 |

*Primary Examiner*—A. Michael Chambers
*Attorney, Agent, or Firm*—LaValle D. Ptak

[57] ABSTRACT

An above-ground gravity return hose retractor, which is particularly useful in service stations for supplying air and water, encloses the hoses and the retraction mechanism within a cabinet. A block and tackle pulley arrangement, including a vertically movable pulley sheave supported by the hose, is located within the cabinet. The movable pulley sheave has a non-linear, variable weight attached to it in the form of an elongated chain having a first segment of small, relatively lightweight links attached through a limit spring to the sheave. These lightweight links then are attached to an additional segment of chain having intermediate weight links, with the lowermost portion of the chain comprising larger, heavier links. The final link in the chain is attached to the bottom of the cabinet. The full length of the chain is reached just prior to the final extension of the hose. The limit spring then provides a significant increase in resistance to further withdrawal of the hose when the chain is fully extended. Upon release, the variable weight chain exerts the greatest pulling force upon initial retraction of the hose, and the retraction pulling force decreases non-linearly to its lowest value when the hose is nearly fully retracted.

20 Claims, 2 Drawing Sheets

FIG. 1
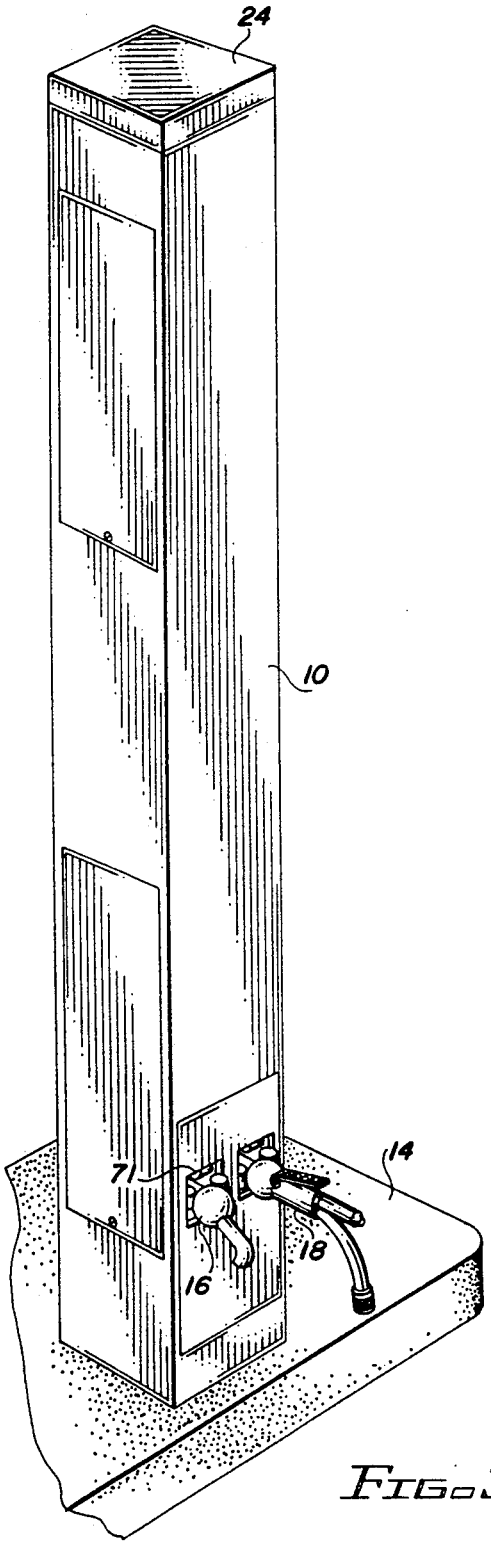
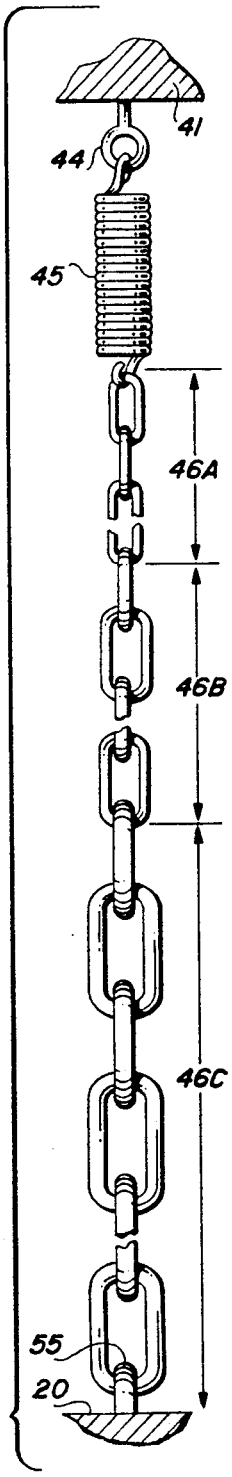
FIG. 3
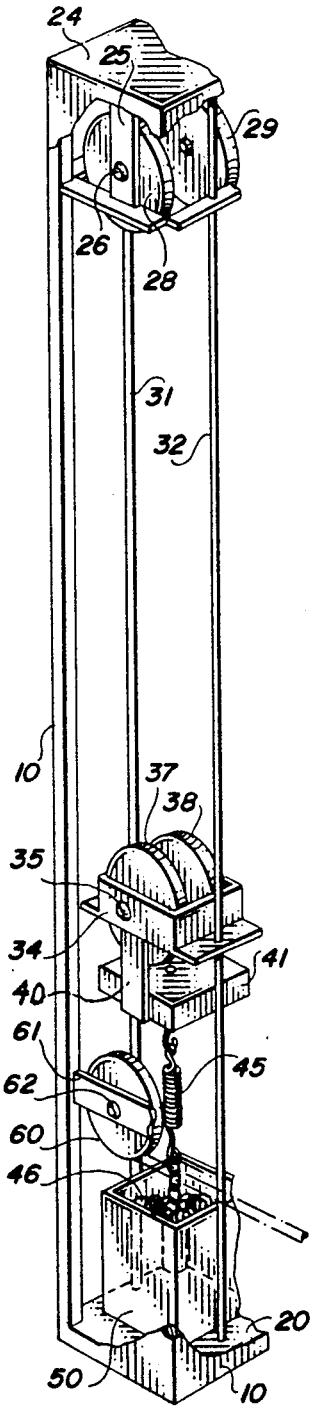
FIG. 2

FLEXIBLE HOSE RETRACTOR

BACKGROUND

Retractable air and water hose mechanisms are extensively used in conjunction with automobile service stations, garages and the like. Such systems generally have a cabinet in which the air and/or water supply hose is housed. Some type of mechanism is used to retract the hose to a storage position. When a customer desires to use the hose to add air to the tires of an automobile parked next to the cabinet, for example, or to obtain water from a water hose located in the cabinet, the user pulls on the nozzle of the hose to withdraw it from a storage position to the point of use. After use, such users generally simply release the hose and the retractor mechanism within the cabinet pulls the hose back to the storage position.

In the past, many water and air hose housings, including appropriate retractor mechanisms, have been located in below-ground wells or buried cabinets. While such underground wells result in an unobtrusive housing, the wells frequently become flooded as a result of rain, snow or even water leaks within a water hose located within them. When the hoses housed in such wells are located in a cold climate, the water within the wells can become frozen, creating significant problems with respect to the withdrawal and return of the hoses into the cabinet. In addition, if a repair or replacement of the hose or any of the retraction mechanism is desired, it is cumbersome and difficult to accomplish such repair or replacement.

Many past retraction mechanisms for returning hoses back to the storage position within a cabinet used spring mechanisms of different types to accomplish this purpose. One such type of spring mechanism for retracting an overhead storage of a hose in a service station is shown in the patent to Johnson U.S. Pat. No. 2,002,777. As illustrated in Johnson, a number of pulleys on opposite sides of the housing are normally pulled toward the housing sides, and a hose is wound in a serpentine path from one side to the other across the pulleys. As the hose is extended, the pulleys move toward the center of the cabinet against the pull of the spring returns. Other types of spring mechanisms have been used to provide the return pull of the hose to cause it to retract to an initial stand-by position. Spring mechanisms, however, are subject to failure, the tension frequently varies with age, and they require lubrication to prevent premature failure.

Hose return mechanisms have been developed which use a fixed weight for a gravity return to retract the hose from an extended use position back to its storage position. Two such mechanisms, employed with below-ground cavities or wells, are disclosed in the patents to Davis U.S. Pat. No. 2,157,887 and Cox U.S. Pat. No. 2,225,859. Fixed weights are used in both of these devices for the retraction; so that the retraction pull becomes the greatest when the hose extension is the least, that is, when the hose is nearly fully retracted. If the user merely releases or lets go of the hose after its use, the pulling force increases since the weight of the portion of the hose already retracted, including its contents, is added to the fixed weight to cause the greatest retracting force to occur immediately at the point of full retraction. Sometimes this results in a relatively violent snapping-back of the hose being retracted, which can result in damage to the hose, the connection between the hose and the nozzle, and the nozzle itself.

Attempts have been made to solve the problem of "snapping-back" of the hose into the storage or stand-by position by providing a variable weight gravity return system in the form of an elongated chain forming the primary return weight. Such a mechanism is shown in the Caldwell U.S. Pat. No. 2,168,951. In Caldwell, the chain in the storage position rests in the bottom of an underground well. As the hose is withdrawn, links of the chain are progressively raised up out of the well to place a return pull or weight on the hose. When the hose is released, the chain settles into the bottom of the housing and the weight of the chain pulling the hose back into the housing diminishes as the hose is drawn into the housing.

An attempt to overcome both the problems of below-ground storage and to provide a variable weight return in a gravity return hose system is disclosed in the apparatus of the Holmgreen U.S. Pat. No. 1,928,178. Holmgreen discloses an above-ground cabinet in which a movable pulley is interconnected by a length of chain with a fixed weight to form the gravity return mechanism. When the hose is fully extended, the weight is lifted a substantial distance from the bottom of the cabinet by the length of chain attached to it. When the hose is released, the chain and weight together provide the initial return force for rapidly pulling the hose back into the retracted position. When the weight strikes the floor of the cabinet, the pull is reduced and the chain collapses on top of the weight in the bottom of the cabinet to progressively reduce the pull on the hose in a manner similar to the device disclosed in the Caldwell patent.

The patent to Walker U.S. Pat. No. 1,518,881 discloses an above-ground cabinet using a weight-operated return mechanism having a fixed weight of the type which is disclosed in the patents to Davis and Cox, discussed above. Thus, the device of Walker is subject to the same disadvantages, insofar as the retraction of the hose is concerned, as has been discussed in conjunction with the Davis and Cox patents Walker, however, does overcome the disadvantages of the wells or pits disclosed in Cox and Davis, since the device of Walker is located in an above-ground cabinet.

Another approach to the problem of "snap-back" of the hose is disclosed in the device of the patent to Sparling U.S. Pat. No. 2,026,237. The Sparling device is an above-ground gravity return hose reel. A fixed return weight is used, but hydraulic damping is employed to prevent snap-back of the hose on return. The weight used in the cabinet operates against the fluid in a hydraulic piston to cause a more gradual return of the hose to its stand-by position. Hydraulic damper mechanisms, however, are subject to substantial variations in operation, depending upon the temperature to which they are subjected. Particularly in extremely cold weather, the hydraulic damping action of the Sparling device is likely to increase to such an extent that full return of the hose does not take place. In such a situation, the nozzle may be left lying on the ground near the cabinet and is subject to extensive damage in the event a car or truck drives over it.

None of the devices disclosed in the patents discussed above includes any provision for cushioning the withdrawal force of a hose from a cabinet when it reaches the end of the length of hose which can be withdrawn from the cabinet. In all of the devices, if the hose is rapidly withdrawn, it reaches a stop, with considerable force on the hose and the connection between the hose and the nozzle, at the time the maximum length is pulled from the cabinet. Consequently, it is possible for the interconnection between the hose and the nozzle to be stressed to the point it breaks.

It is desirable to provide an above-ground gravity-operated hose return mechanism which is simple in structure, effective in operation, which minimizes "snap-back," is adaptable to various installation conditions, and which also reduces the possibility of damage caused by attempts to over-extend the hose from the cabinet.

SUMMARY OF THE INVENTION

Accordingly, it is an object of this invention to provide an improved hose return mechanism.

It is another object of this invention to provide an improved gravity-operated hose retractor mechanism.

It is an additional object of this invention to provide an improved above-ground gravity return hose retractor which minimizes "snap-back" of the hose when it is released.

It is a further object of this invention to provide an improved above-ground variable weight gravity return hose retractor.

It is yet another object of this invention to provide an improved hose retractor having a resilient cushioning of the final portion of the extension of the hose.

In accordance with a preferred embodiment of this invention, a gravity return hose retractor is mounted in an above-ground cabinet, including a fluid feed-pipe. A hose is connected at one end to the feed-pipe and has a nozzle on the other end and extending out of the cabinet. Inside the cabinet, the hose extends over a movable pulley device mounted for vertical movement in the cabinet as the nozzle is pulled away from and returned to the cabinet. A variable weight is attached to the movable pulley for adding increasing amounts of weight to the pulley device in non-linear increments as the hose is withdrawn from the cabinet up to a first relatively long distance from the cabinet. In addition, a resilient limit cushion significantly increases the resistance to hose withdrawal for a second, much shorter distance after the hose has been withdrawn from the cabinet the first distance.

BRIEF DESCRIPTION OF THE DRAWINGS

FIG. 1 is a block diagram of a cabinet for housing a preferred embodiment of the invention;

FIG. 2 is a perspective diagram of the mechanism of a preferred embodiment of the invention;

FIG. 3 illustrates features of the mechanism shown in FIG. 2; and

DETAILED DESCRIPTION

Figure 4:
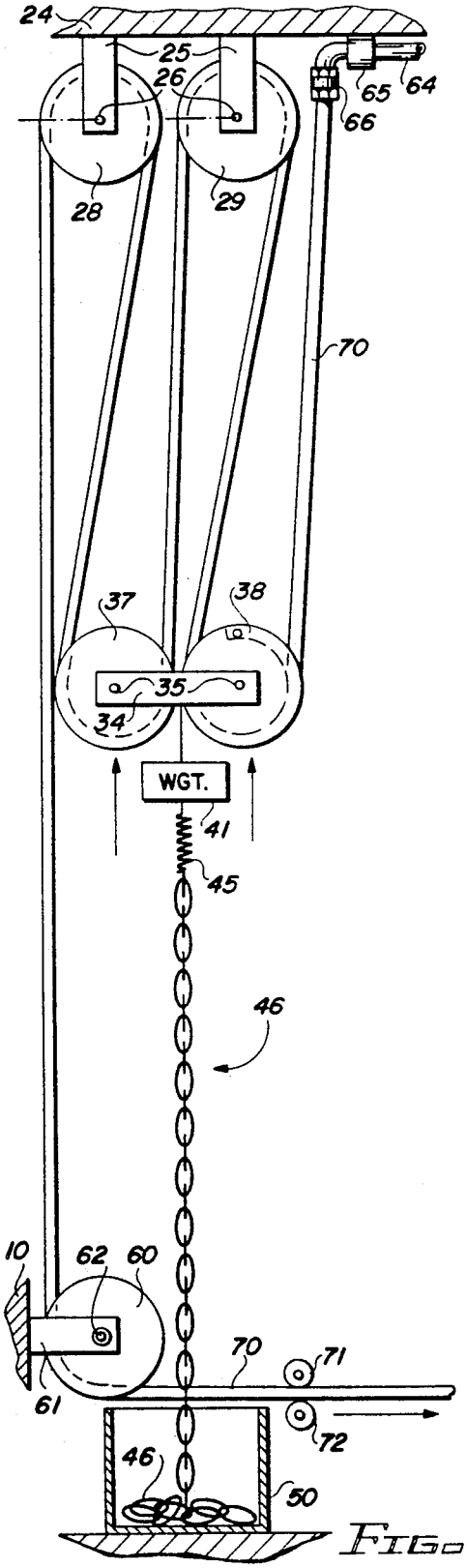
FIGS. 4 and 5 are diagrammatic representations showing the operation of the embodiment shown in FIGS. 1 through 3.

Reference now should be made to the drawings in which the same reference numbers are used throughout the different figures to designate the same or similar components.

Referring now to FIG. 1, a vertical, above-ground cabinet 10 is shown for housing and protecting the gravity-operated hose retractor of the invention. The cabinet 10 is a relatively narrow cabinet, eight to 10 feet tall. The cabinet 10 is attached by any suitable means to a concrete platform or other suitable base 14, located adjacent the area where air and water service is to take place.

Near the base of the cabinet 10, a pair of hose openings are provided for a water hose and air hose. The water hose is connected at its lowermost end to a water dispensing nozzle 16, and the air hose is connected to an air dispensing nozzle 18. Both of the nozzles, 16 and 18, may be of any standard configuration and typically have an enlarged, resilient ball on them near or at the point where they are connected to the hose, to prevent the retraction mechanism within the cabinet 10 from drawing the nozzles back into the cabinet through the openings shown in FIG. 1.

FIG. 2 is a diagrammatic perspective view of the retraction mechanism for the water hose to which the nozzle 16 of FIG. 1 is attached A duplicate (not shown) of the mechanism shown in FIG. 2 is provided in the other half of the cabinet, for the air hose 18, and the two hoses are independently retractable and are independently returned into the cabinet by separate identical retractor mechanisms. Typically, the hoses which are used are steel braided hoses of the type employed in service stations and the like for dispensing air and water. The cabinet 10, the base 20, and the top 24 copmrise the structural support for the retracting mechanisms. To illustrate the mechanism in FIG. 2, however, the panels 10 have been removed, except at the corners.

An upper dual sheave pulley block includes a pair of upper idler pulleys 28 and 29, supported from the top 24 by a frame 25 on a common shaft 26. Typically, the pulleys 28 and 29 are mounted on the shaft 26 through a suitable bearing. A pair of guide rods 31 and 32 extend from the top of the cabinet all the way to the bottom as shown in FIG. 2 for the purpose of providing a vertical guide for a movable dual sheave pulley block, consisting of a second pair of pulleys 37 and 38, carried by a frame 34 and rotatably mounted on a shaft 35, extending across the frame 34. The frame 34 has a flange extending on opposite sides with holes through it for the respective guide rods 31 and 32, to cause the frame to be guided on the guide rods 31 and 32. A fixed weight 41 is attached to the bottom of the frame 34 below the pulleys 37 and 38 by a pair of downwardly extending flanges 40, located on each side of the frame 34. The actual weight of the weight 41 is adjusted at the time of installation to compensate for different variables, such as the base contents (air or water), the nature of the surface adjacent the cabinet 10, and the slope of the ground adjacent the cabinet 10.

As shown most clearly in FIG. 3, an eye 44 is attached to the bottom of the weight 41, substantially at its center; and a resilient coil spring 45 then is attached to the eye. The lower end of the spring 45 is connected to the upper link of an elongated chain 46, which functions as a variable weight. The bottom link of the chain is secured to a ring 55 which, in turn, is firmly attached to the floor or base 20 of the cabinet. The chain 46 includes multiple segments of links of different weights (typically accomplished by making the links of different sizes), with an upper segment 46A consisting of links of a first smallest size. An intermediate segment 46B of the chain includes links of intermediate size, each having a weight which is greater than the weight of the links in the segment 46A; and the bottom portion of the chain 46 is comprised of a segment of chain links 46C which are larger or heavier than the intermediate links of the segment 46B.

When the hoses, which are retracted by the mechanism shown in FIGS. 2 and 3, are fully retracted to the stand-by position shown in FIG. 1, the chain 46 collapses into a storage box 50 to prevent it from spilling over into the other side of the cabinet where an identical mechanism for retracting the air hose attached to the nozzle 18 is located.

Figure 5:
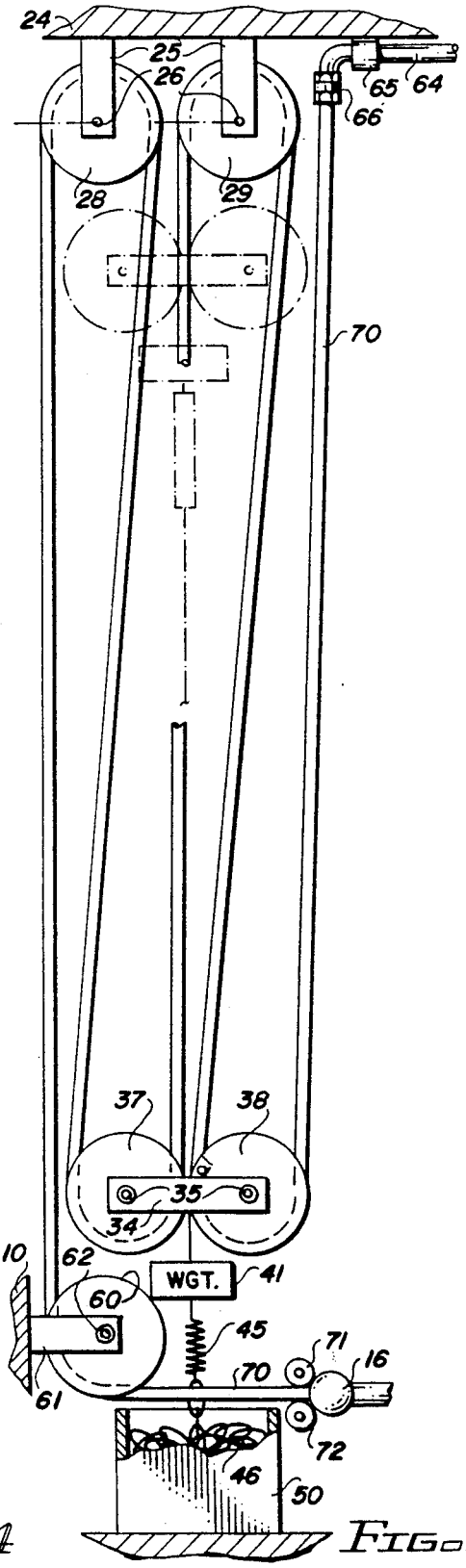

Reference now should be made to FIGS. 4 and 5, taken in conjunction with the mechanism shown in FIGS. 2 and 3, for an understanding of the operation of the retraction mechanism of the preferred embodiment of the invention. The pulley arrangements of the FIGS. 4 and 5 are shown diagrammatically to illustrate the manner in which the "block and tackle" pulley mechanism of the device as shown in FIGS. 2 and 3 operates. This is done by showing the pairs of pulleys 28/29 and 37/38 as staggered longitudinally in FIGS. 4 and 5, whereas in actual construction they are located side by side, as illustrated in FIG. 2. The illustration of FIGS. 4 and 5, however, facilitates an understanding of the operation of the system from a functional standpoint.

As illustrated in FIG. 4, a fluid supply line or feed-pipe 64 is attached to the top 24 of the cabinet 10 by means of a clamp or bracket 65 which may of any suitable type. A connector 66 then is used to connect one end of a steel braided fluid supply hose 70 to the supply pipe 64. The hose 70 then is led around the pulleys 38, 29, 37, 28 in the manner in which a typical block and tackle pulley arrangement is interconnected, with the nozzle end of the hose 70 then passing over a lower idler pulley 60 attached to the rear left corner of the cabinet 10 by means of a bracket 61. The pulley 60 rotates on a pivot 62 in a conventional manner. The hose 70 finally passes out of the cabinet 10 through a pair of guide rollers 71 and 72 of standard configuration which are mounted in the opening in the front of the cabinet and are attached to the nozzle 16, illustrated in FIGS. 1 and 5.

When the nozzle 16 is pulled away from or outwardly from the cabinet (to the right in FIG. 4), the hose 70 causes the pulley sheave consisting of the pulleys 37 and 38 and mounted in the frame 35, to move upwardly in the direction of the arrows shown in FIG. 4. This movement continues to a maximum height illustrated in dotted lines in FIG. 5. When this maximum height is reached, all of the links of the chain 46 in all of the segments, 46A through 46C, are fully extended to cause the chain to assume the taut configuration shown in FIG. 3. This causes any further upward movement of the sheave with the pulleys 37 and 38 and the weight 41 to increase the tension force on the coil spring 45, as the spring 45 is stretched. Until the maximum extension of the hose 70 takes place, the spring 45 simply acts as a relatively rigid interconnection between the eye 44 attached to the weight 41, and the upper link of the chain 46 in the segment 46A. Under normal conditions of operation, the spring 45 is never extended. If, however, the hose 70 is pulled to its maximum extended length, the final portion of this pulling of the hose is against the significantly increased additional force or resistance required to stretch the spring 45. This operates as a cushion against any sudden shock which otherwise would be caused by the pulling of the hose 70 rapidly to its limit out of the cabinet.

It also is apparent that as the hose 70 is pulled outwardly from the cabinet, there is less weight of the hose itself pulling downwardly on the top idler pulleys 28 and 29. As less weight of hose pulls downwardly, however, increasing amounts of weight of the different segments of the chain 46 are added to the fixed weight 41 attached to the bottom of the bracket 34 or pulley sheave for the pulleys 37 and 38. This results in a relatively constant pulling force required to extend the hose 70 to any distance up to its maximum length away from the cabinet as it is moved outwardly from the cabinet to the right as shown in the bottom of FIG. 4. The increasing variable weight of the chain 46 compensates for the variation in the weight of the extended hose to accomplish this result.

Upon release, the chain 46 drops into the box 50. As is readily apparent from an examination of FIG. 3, the heaviest links of the chain 46 in the segment 46C first drop into the box 50, and as each link is stored in the box, the weight pulling downwardly on the movable pulley sheave, including the frame 34 and the pulleys 37 and 38, is reduced. This reduction in weight is a non-linear reduction since the different segments (46A to 46C) of chain have links of different weights in them. Consequently, the pull on the bottom of the movable pulley sheave 34 is reduced as the sheave 34 approaches the position shown in solid lines in FIG. 5. As the nozzle 16 approaches the cabinet, the pull is non-linearly reduced to its lowest amount, so that minimal shock to the hose 70 and the nozzle 16, along with the other portions of the apparatus, takes place. This minimal shock occurs even if the hose is allowed to "snap-back" without any restraint, since the non-linear variable weight of the chain 46 causes in initial rapid return at the fully extended position of the hose with the pull reducing to a minimum amount as the nozzle 16 approaches the guide rollers 71 and 72. To prevent damage to the pulley sheave 34 in the event the hose 70 is cut, cushion springs (not shown) can be placed over the lower ends of the guide rods 31 and 32 to cushion the drop of the moveable pulley sheave.

The foregoing description of the preferred embodiment of the invention, taken in conjunction with the drawings, is to be considered illustrative of the invention and not as limiting. Various changes and modifications will occur to those skilled in the art. For example, while the embodiment illustrated uses a pair of upper idler pulleys and a pair of movable pulleys, a single upper pulley and a single movable pulley could be employed, although the length of hose 70 which could be withdrawn from a cabinet of the same height would be considerably less than with the arrangement shown and described. The number of retraction mechanisms located within a single cabinet also can be varied in accordance with the number of different fluids to be dispensed and/or the particular application with which the apparatus is to be used. In addition, it is readily apparent that the enclosed cabinet permits the utilization of heating devices or the like to prevent freezing of the fluids in any of the hoses when the device is used in cold weather. The particular arrangement of weights can be varied, as can the type and number of different sized links in the chain 46. Various other changes and modifications will occur to those skilled in the art without departing from the true scope of the invention as defined in the appended claims.

I claim:

1. An improvement in a gravity return hose retractor mounted in an above-ground cabinet including a fluid feed-pipe, a hose connected at one end to the feed-pipe with a nozzle on the other end of the hose and extending out of the cabinet, the hose extending over movable pulley means mounted for vertical movement in the cabinet as the nozzle and hose are pulled away from and returned to the cabinet, the improvement including in combination:

variable weight means attached to said movable pulley means for adding increasing amounts of weights to said pulley means in non-linear increments, such that greater weight is added per unit of distance as said hose is withdrawn from the cabinet to increasingly greater distances up to a first predetermined distance from the cabinet; and resilient limit means for significantly increasing resistance to hose withdrawal for a second predetermined distance after the hose has been withdrawn from the cabinet said first predetermined distance.

2. The combination according to claim 1 wherein said variable weight means includes, at least in part, an elongated chain connected to said movable pulley means and comprising interconnected segments in which each of said segments has links of different weight from the weight of the links in other segments.

3. The combination according to claim 2 wherein said chain is attached to said movable pulley means by said resilient limit means.

4. The combination according to claim 3 wherein the link in said chain most remote from said movable pulley means is secured to the bottom of said cabinet.

5. The combination according to claim 4 further including means for guiding the movement of said movable pulley means in the cabinet.

6. The combination according to claim 5 further including a receptacle for storing said chain.

7. The combination according to claim 6 wherein said chain comprises at least three segments of links, with the lowermost of the three segments having links of a weight greater than the weight of the links of the intermediate segment which, in turn, has links of a weight greater than the weight of the links of the uppermost segment which is attached to said movable pulley means.

8. The combination according to claim 7 wherein said movable pulley means is supported on said hose for movement upward within said cabinet as said hose is withdrawn from said cabinet and for movement downward in said cabinet under the gravity pull of said variable weight means when said hose is released and returned to said cabinet.

9. The combination according to claim 8 wherein said resilient limit means comprises a spring.

10. The combination according to claim 9 wherein said spring comprises a coil spring.

11. The combination according to claim 1 wherein said resilient limit means comprises a spring.

12. The combination according to claim 11 wherein said spring comprises a coil spring.

13. The combination according to claim 11 wherein said variable weight means includes, at least in part, an elongated chain connected to said movable pulley means and comprising interconnected segments in which each of said segments has links of different weight from the weight of the links in other segments.

14. The combination according to claim 13 wherein the link in said chain most remote from said movable pulley means is secured to the bottom of said cabinet.

15. The combination according to claim 14 wherein said chain is attached to said movable pulley means by said resilient limit means.

16. The combination according to claim 1 further including means for guiding the movement of said movable pulley means in the cabinet.

17. The combination according to claim 16 wherein said movable pulley means is supported on said hose for movement upward within said cabinet as said hose is withdrawn from said cabinet and for movement downward in said cabinet under the gravity pull of said variable weight means when said hose is released and returned to said cabinet.

18. The combination according to claim 17 wherein said variable weight means includes, at least in part, an elongated chain connected to said movable pulley means and comprising interconnected segments in which each of said segments has links of different weight from the weight of the links in other segments.

19. The combination according to claim 18 wherein the link in said chain most remote from said movable pulley means is secured to the bottom of said cabinet.

20. The combination according to claim 19 wherein said chain is attached to said movable pulley means by said resilient limit means.

* * * * *